US011007398B2

(12) United States Patent
Neuhaus et al.

(10) Patent No.: US 11,007,398 B2
(45) Date of Patent: May 18, 2021

(54) PARALLEL CABLE EXERCISE DEVICE

(71) Applicants: Peter Neuhaus, Pensacola, FL (US); Tyson Cobb, Pensacola, FL (US); Jeremy Gines, Pensacola, FL (US); Travis Craig, Pensacola, FL (US)

(72) Inventors: Peter Neuhaus, Pensacola, FL (US); Tyson Cobb, Pensacola, FL (US); Jeremy Gines, Pensacola, FL (US); Travis Craig, Pensacola, FL (US)

(73) Assignee: Florida Institute for Human & Machine Cognition, Inc., Pensacola, FL (US)

( * ) Notice: Subject to any disclaimer, the term of this patent is extended or adjusted under 35 U.S.C. 154(b) by 0 days.

(21) Appl. No.: 16/410,647

(22) Filed: May 13, 2019

(65) Prior Publication Data

US 2019/0344115 A1 Nov. 14, 2019

Related U.S. Application Data

(60) Provisional application No. 62/670,903, filed on May 14, 2018.

(51) Int. Cl.

| | |
|---|---|
| ***A63B 21/00*** | (2006.01) |
| ***A63B 21/005*** | (2006.01) |
| ***A63B 24/00*** | (2006.01) |
| ***A63B 23/12*** | (2006.01) |
| ***A63B 23/035*** | (2006.01) |

(Continued)

(52) U.S. Cl.

CPC ..... *A63B 21/151* (2013.01); *A63B 21/0058* (2013.01); *A63B 23/03525* (2013.01); *A63B 23/12* (2013.01); *A63B 24/0062* (2013.01); *A63B 71/0054* (2013.01); *A63B 2023/0411* (2013.01); *A63B 2024/0093* (2013.01); *A63B 2071/0081* (2013.01); *A63B 2208/0204* (2013.01); *A63B 2220/51* (2013.01)

(58) Field of Classification Search

CPC ..... A63B 21/151; A63B 21/0058; A63B 24/0062; A63B 71/0054; A63B 23/12; A63B 23/03525; A63B 2208/0204; A63B 2220/51; A63B 2024/0093; A63B 2071/0081; A63B 2023/0411; A63B 2208/0223; A63B 2220/80; A63B 2071/0072; A63B 2225/102; A63B 71/0619; A63B 2220/16; A63B 2220/806; A63B 2220/10; A63B 2220/833; A63B 2220/54; A63B 2209/00

See application file for complete search history.

(56) References Cited

U.S. PATENT DOCUMENTS 3,848,467 A * 11/1974 Flavell ..... A63B 21/153 482/4

4,647,039 A * 3/1987 Noffsinger ..... A63B 21/0058 482/130

(Continued)

*Primary Examiner* — Andrew S Lo

(74) *Attorney, Agent, or Firm* — J. Wiley Horton

(57) ABSTRACT

A cable-based exercise system. A chassis is provided to house the actuators. A force plate sits on top of this chassis. A bar configured for gripping by a user is provided. The bar has a first end and a second end. Two or more cables are connected to each end of the bar. Each cable connects an end of the bar to a drive motor. Each drive motor can be independently controlled. A central processor is preferably provided to receive sensory inputs and control the drive motors.

20 Claims, 4 Drawing Sheets

(51) Int. Cl.
*A63B 23/04* (2006.01)
*A63B 71/00* (2006.01)

(56) References Cited

U.S. PATENT DOCUMENTS 4,912,638 A * 3/1990 Pratt, Jr. ..... A61B 5/1121 128/905
6,280,361 B1 * 8/2001 Harvey ..... A63B 21/025 482/101
8,092,355 B2 * 1/2012 Mortimer ..... A63B 24/00 482/142
8,315,823 B2 * 11/2012 Berme ..... G01L 25/00 702/41
8,845,499 B1 * 9/2014 Boatwright ..... A63B 23/03525 482/116
9,149,222 B1 * 10/2015 Zets ..... A61B 5/1116
9,168,420 B1 * 10/2015 Berme ..... A63B 22/02
9,327,160 B2 * 5/2016 Tauriainen ..... A63B 21/0783
9,526,451 B1 * 12/2016 Berme ..... A63B 24/0062
10,328,307 B2 * 6/2019 Schmidt ..... A63B 24/0003
2009/0062092 A1 * 3/2009 Mortimer ..... A63B 26/003 482/142
2011/0260890 A1 * 10/2011 Larsen ..... A63B 69/3667 341/20
2012/0094814 A1 * 4/2012 Atkins ..... A63B 71/0622 482/142
2016/0128642 A1 * 5/2016 Barralon ..... A61B 5/6823 600/592
2016/0346601 A1 * 12/2016 Marcandelli ..... A61B 5/11
2016/0354638 A1 * 12/2016 Carr ..... A63B 24/0087
2017/0203143 A1 * 7/2017 Ferlito ..... A63B 21/063
2017/0296113 A1 * 10/2017 Cheung ..... A61B 5/1116
2017/0333756 A1 * 11/2017 Bird ..... A63B 21/151
2018/0200562 A1 * 7/2018 Nesbit ..... A63B 21/0783
2018/0214729 A1 * 8/2018 Rubin ..... G16H 20/30
2018/0353813 A9 * 12/2018 Bird ..... A63B 23/03525
2019/0105526 A1 * 4/2019 Boatwright ..... A63B 21/00069
2019/0307387 A1 * 10/2019 An ..... A61B 5/1101
2019/0344123 A1 * 11/2019 Rubin ..... A63B 21/0054
2019/0357838 A1 * 11/2019 An ..... A61B 5/4023

* cited by examiner

PARALLEL CABLE EXERCISE DEVICE

CROSS-REFERENCES TO RELATED APPLICATIONS

This non-provisional patent application claims benefit of an earlier-filed provisional application. The provisional application listed the same inventor. It was assigned application Ser. No. 62/670,903.

STATEMENT REGARDING FEDERALLY SPONSORED RESEARCH OR DEVELOPMENT

Not applicable

MICROFICHE APPENDIX

Not Applicable

BACKGROUND OF THE INVENTION

1. Field of the Invention

The present invention pertains to the field of exercise equipment. More specifically, the invention comprises a cable-actuated force application system that can be used to mimic traditional free weights and provide other functionality as well.

2. Description of the Related Art

Many different types of exercise devices are known. The use of free weights for strength and cardiovascular training is particularly beneficial because the user must generally control six degrees of freedom for the weight being lifted. This fact means that many smaller muscles must be used to stabilize the position of the weight in addition to the muscles the particular exercise is designed to employ. Free weights also present risk, however. A user may accidentally drop a free weight. Worse, the free weight may create a situation where the user's balance is lost and the descent to the ground is exacerbated by the accelerating weight.

It would be desirable to provide a free weight for exercise where the presence of the weight could be eliminated when a dangerous situation is detected (such as a loss of balance). Of course, one cannot simply switch off the mass of a free weight. One advantage of the present invention is its ability to mimic the forces created by moving a free weight while largely eliminating the risk a free weight creates. The present invention provides other advantages as well.

BRIEF SUMMARY OF THE INVENTION

The present invention comprises a cable-based exercise system. A chassis is provided to house the actuators. A force plate sits on top of this chassis. A bar configured for gripping by a user is provided. The bar has a first end and a second end. Two or more cables are connected to each end of the bar. Each cable connect, an end of the bat to a drive motor. Each drive motor can be independently controlled. A central processor is preferably provided to receive sensory inputs and control the drive motors.

In use, a user stands on the force plate and applies force to the bar (such as curling the bar or lifting the bar). The reactive forces of the user's feet on the force plate are preferably measured and sent to the processor. The angular position of each drive motor is preferably also measured and sent to the processor. The processor controls the torque and position for each drive motor in order to create a desired exercise configuration for the bar (via tensile forces applied through the cables). This control can be provided in a dynamic situation where the bar is moving. The processor is also preferably configured to detect abnormal situations such as a loss of the user's balance. In such a situation the controller can remove the forces applied to the bar.

REFERENCE NUMERALS IN THE DRAWINGS

Figure 1:
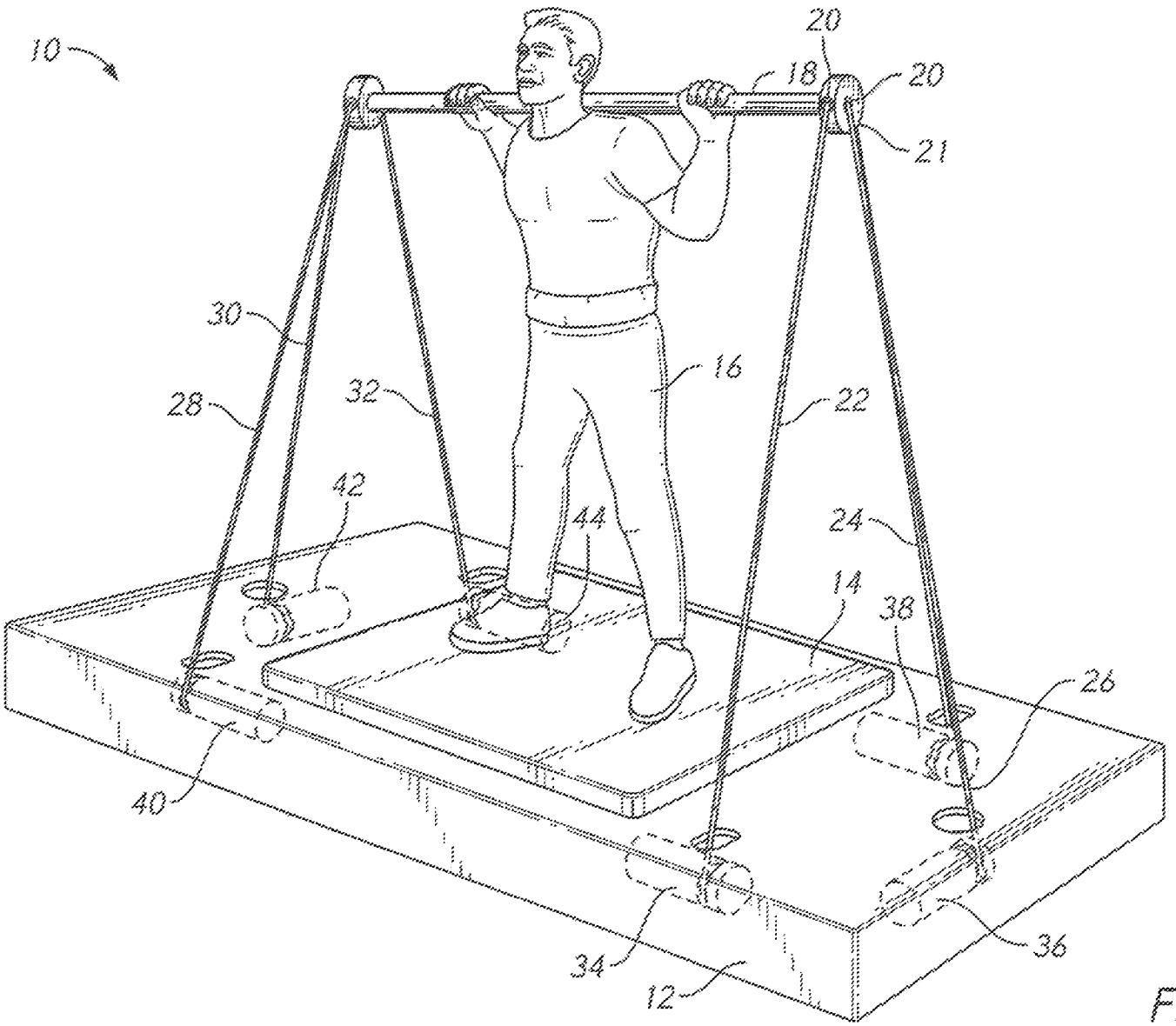
FIG. 1 is a perspective view, showing a user employing the present invention.

10 cable driven exercise device
12 chassis
14 force plate
16 user
18 bar
20 cable anchor
21 anchor plate
22 left front cable
24 left rear table
26 left lateral cable
28 right front cable
30 right lateral cable
32 right rear cable
34 left front motor
36 left lateral motor
38 left rear motor
40 right front motor
42 right lateral motor
44 right rear motor
46 load cell
48 processor
50 controller
52 power supply
54 defined force object

DETAILED DESCRIPTION OF THE INVENTION

FIG. 1 illustrates an exemplary embodiment of the inventive device. Chassis 12 provides both a structural base and a housing for many other components. Force plate 14 sits on top of chassis 12. User 16 stands on top of force plate 14 while using the device. Bar 18 is configured to be grasped by the user during the operation of the device. Ordinarily bar 18 will be moved through a desired range of positions. However, the inventive device is also capable of providing useful forces while the bar remains stationary.

The various components will now be described with respect to the orientation of the user shown in FIG. 1. Directional terms such as left, right, front, and rear should not be viewed as limiting. Rather, they are properly viewed as a convenient frame of reference from the vantage point of user 16.

Bar 18 has a left end and a right end. An anchor plate 21 is provided on both ends. This optional anchor plate is provided for the convenient attachment of cable anchors 20. As an example, the upper end of left front cable 22 is attached to the left anchor plate. The lower end of the same left front cable is attached to a drum connected to left front motor 34. The drum on left front motor 34 is preferably able to precisely control the tension on left front cable 22 and to precisely control the distance from the point where the cable departs the drum to the left anchor plate 21 (the linear extension of left front cable 22). As depicted in FIG. 1, all the motors are attached to chassis 12 and the cables leading from each motor pass through openings in the chassis. Fairlead devices may also be provided to minimize frictional engagement between the cables and other components.

Left rear cable 24 connects between the left anchor plate 21 and a drum mounted on left rear motor 38. As for the left front motor, left rear motor 38 is preferably able to precisely control both the tension on left rear cable 24 and the linear extension of left rear cable 24.

Similar cable and drive systems are present on the right end of bar 18. Right front cable 28 connects between the right anchor plate 21 and a drum mounted on right front motor 40. Right rear cable 32 connects between the right anchor plate and a drum mounted on right rear motor 44.

Those skilled in the art will appreciate that the presence of cables 22, 24, 28, 32 and motors 34, 38, 42, 44 allow a stable and controlled application of force to bar 18. However, those skilled in the art will also appreciate that the application of lateral forces (again, "lateral" being understood from the perspective of the user 16) is limited in this scenario. In order to address this potential concern, another preferred embodiment of the present invention includes two lateral cables.

In this six-cable embodiment, left lateral cable 26 connects the left anchor plate 21 to a drum attached to left lateral motor 36. Similarly, right lateral cable 30 connects the right anchor plate 21 to a drum attached to right lateral motor 42. The addition of these two lateral cables increases the directions in which the inventive system can apply force to bar 18.

Each cable is connected to a drum on a motor. Bach motor is controllable in terms of its angular position and the amount of torque it applies. As an example, each motor may be a digitally controlled stepper motor. Each drum may include a helical groove that precisely guides the cable into position as the cable unwinds and rewinds with the motion of the bar and the motor. In other embodiments each drum may include a ball mechanism which precisely guides the cable onto the drum. Each motor can be precisely controlled in terms of its angular position from a fixed starting point and the amount of torque it applies. As long as the cable is precisely guided on and off the drum, the angular position of the drum can be translated into a precise amount of linear extension for the cable.

Figure 2:
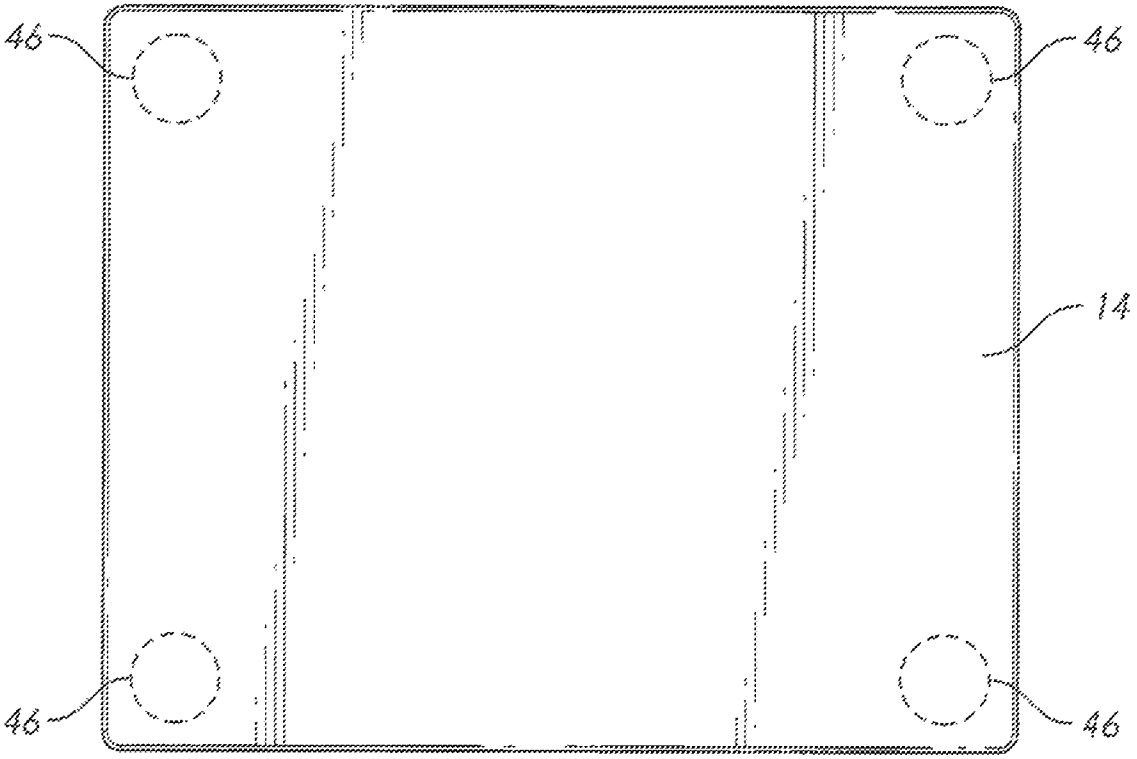
FIG. 2 is a plan view, showing the force plate and an exemplary location for a set of load cells.

FIG. 2 depicts a plan view for force plate 14. It is helpful to know the location of the user's center of pressure and the amount of reactive force being exerted by the user on force plate 14. One approach to gathering this information is the provision of a load cell 46 on each corner of the force plate. This load cell provides force information to a central processor.

Figure 3:
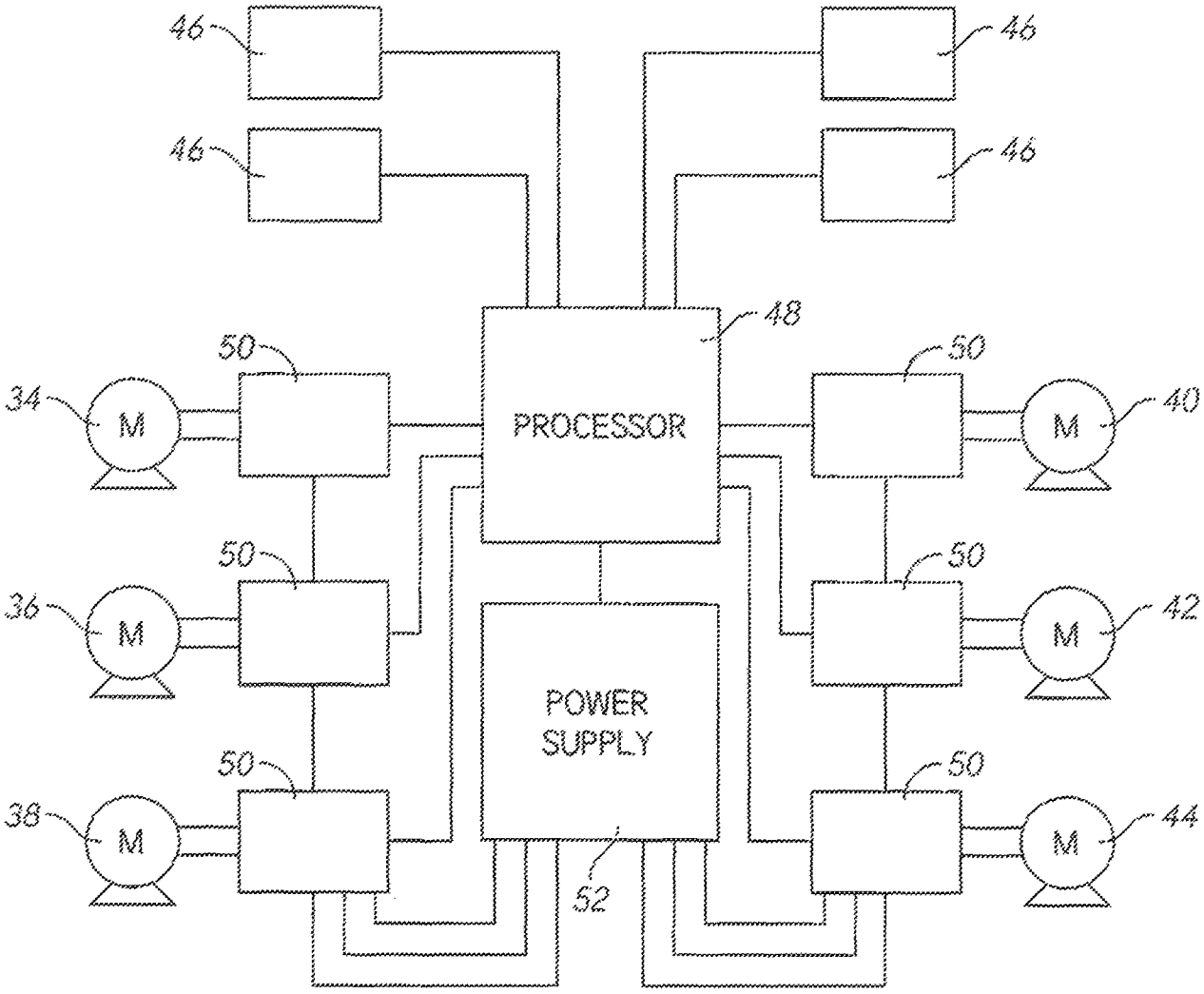
FIG. 3 is a schematic view, showing a simplified depiction of a control system.

FIG. 3 schematically depicts a simple data gathering and overall control system for the invention of FIG. 1. Processor 48 can be mounted in the chassis or mounted separately—such as on a pedestal. The processor employed may even be located in a separate computing device—such as a tablet or notebook computer.

Each motor 34, 36, 38, 40, 42, 44 is provided with its own motor controller 50. The motor controller drives the motor to a desired position, velocity, and torque. Each motor controller also receives positional information from an encoder on the motor itself. Processor 48 sends data to each controller 50 giving desired position, velocity, and torque. Each motor controller then provides local control of its associated motor to achieve those results.

The four load cells 46 also provide information to processor 48. Power supply 52 is configured to provide power to the processor, the load cells, and the motor controllers. A separate (higher current) power supply may be used for the motors themselves.

The processor runs software configured to provide desired exercise functionality for the inventive device. Returning to FIG. 1, the system may be initiated to provide little to no resistive force. The user can lift bar 18 (which may only way 5-7 kg) to the position shown. However, once the exercise routine is activated, the six cables can apply force configured to mimic the action of squatting a 100 kg mass. The recreation of the characteristics of a free weight can be more complex than simply the gravitational force. The system can also mimic the dynamic forces—such as the additional upward force needed to arrest the downward momentum at the bottom of a squat.

The inventive system may also incorporate a counterweight arm configured to hold the bar at a convenient height (such as 100 cm) without the addition of any force. Such a device eliminates the need to lift the bar from the top of force plate 14.

Figure 4:
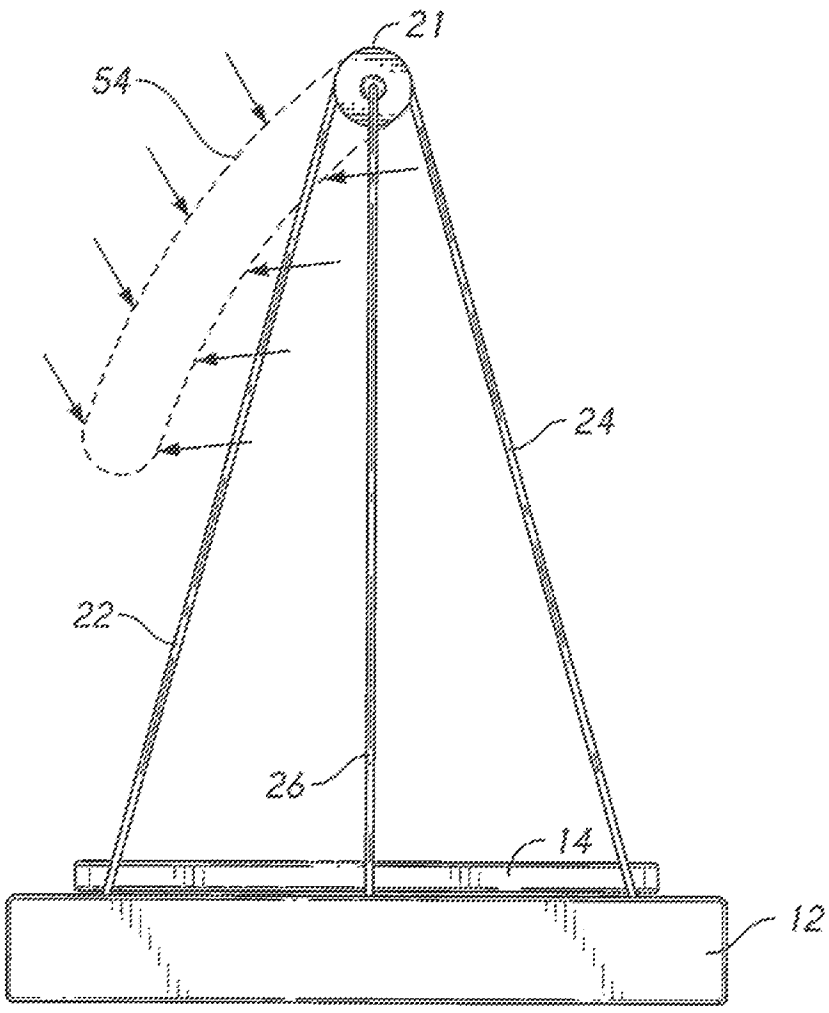
FIG. 4 is a side elevation view, showing the creation of a defined force object.

Using software running on the processor, the inventive device can do more than simply mimic the dynamics of free weights. The software can define an arbitrary unloaded path which the user intuitively learns to guide the bar along. This unloaded path can aid in various therapies. FIG. 4 shows a side elevation view of the embodiment of FIG. 1. Defined force object 54 represents an arbitrary path of least resistance defined by the software. The arrows indicate arbitrary forces that can be applied as the user moves the bar along the dotted line.

The reactive forces measured by force plate 14 can be used in many ways. As an example, the processor can compute an instantaneous center of pressure and compare its location to the user's boundary of balance stability (generally a polygon defining the geometric boundary of where the center of pressure can be without causing a loss of balance). If the center of pressure moves outside this polygon the processor can immediately remove tension on all the cables so the user will not fall.

The invention preferably incorporates one or more of the following features:

1. The force plate can be a single plate or two separate foot plates. The data collected includes center of pressure and total force. This can be presented to the user on a display.

2. For the embodiments having three cables per side, the invention can apply force in three dimensions.

3. Some embodiments may not include the sensing of force applied in each cable. Rather, they can just sense the reactive forces on the force plate and use this information to adjust the torque applied by each motor.

4. The invention can include a motion capture system configured to capture the user's motion in real time. The user's motion can then be displayed to the user or a trainer.

5. A camera system can be included to record and play back video of the user.

6. The invention can include a graphical user interface designed to allow the user to easily control and monitor the operation of the components (such as on a standalone tablet).

7. The device can include interchangeable bars configured for use in specific exercises. For example, the device might include one type of bar for squats and another type of bar for curls. The device could even include two separate grips rather than a single bar.

8. The device can provide an aerobic mode in which more rapid motion with lighter loads is implemented.

9. The device can record precise data as to the position of the bar at all points during an exercise cycle.

10. The processor performs calculations to determine the precise position and torque for each drive motor many times per second.

11. The inventive system can provide a constant force over a very wide range of motion.

12. The inventive system can accurately mimic free weights while greatly reducing the risk of injury.

13. The inventive system can mimic the action of eccentric overloading exercise machines. The load can be varied in a much more complex fashion than is possible using devices such as mechanical cams.

14. An additional resistive force can be added to limit speed of motion if desired.

15. Perturbation loading can be applied to create random or pseudo random force disturbances.

16. Perturbation can be added to regular loads to assess the user's balance capabilities or to enhance them over time.

17. The processor can be configured to sense user fatigue and reduce load complexity as the exercise cycles continue.

18. Emergency release of all cable tension can be created by a user pressing a button or pulling a cord. Emergency release can also be produced automatically—such as by detecting a loss of balance.

The preceding description contains significant detail regarding the novel aspects of the present invention. It is should not be construed, however, as limiting the scope of the invention but rather as providing illustrations of the preferred embodiments of the invention. Thus, the scope of the invention should be fixed by the claims ultimately presented, rather than by the examples given.

Having described our invention, we claim:

1. An exercise device for a user, comprising:
(a) a chassis;
(b) a bar, having an left end and a right end;
(c) a left front motor driving a left front motor drum;
(d) a left front cable extending from said left front motor drum to said left end of said bar;
(e) a left rear motor driving a left rear motor drum;
(f) a left rear cable extending from said left rear motor drum to said left end of said bar;
(g) a right front motor driving a right front motor drum;
(h) a right front cable extending from said right front motor drum to said right end of said bar;
(i) a right rear motor driving a right rear motor drum;
(j) a right rear cable extending from said right rear motor drum to said right end of said bar;
(k) a control system configured to produce a desired angular position and torque for each of said left front motor, said left rear motor, said right front motor, and said right rear motor in order to apply a desired force to said bar;
(l) a force plate positioned beneath said user;
(m) wherein said force plate is monitored by said control system in order to monitor a balance state of said user; and
(n) wherein said control system is configured to remove all loads on all cables in the event an unbalanced state of said user is detected.

2. The exercise device as recited in claim 1, wherein said force plate is suspended on four load cells.

3. The exercise device as recited in claim 2, wherein:
(a) said four load cells are monitored by said control system; and
(b) said control system uses said load cells to monitor said balance state of said user.

4. The exercise device as recited in claim 1, further comprising:
(a) a left anchor plate on said left end of said bar;
(b) a right anchor plate on said right end of said bar;
(c) wherein said left front cable and said left rear cable attach to said left anchor plate; and
(d) wherein said right front cable and said right rear cable attach to said right anchor plate.

5. The exercise device as recited in claim 1, further comprising:
(a) a left lateral motor driving a left lateral motor drum,
(b) a left lateral cable extending from said left lateral motor drum to said left end of said bar;
(c) a right lateral motor driving a right lateral motor drum; and
(d) a right lateral cable extending from said right lateral motor drum to said right end of said bar.

6. The exercise device as recited in claim 5, wherein said force plate is suspended on four load cells.

7. The exercise device as recited in claim 6, wherein:
(a) said four load cells are monitored by said control system; and
(b) said control system uses said load cells to monitor said balance state of said user.

8. The exercise device as recited in claim 5, further comprising:
(a) a left anchor plate on said left end of said bar;
(b) a right anchor plate on said right end of said bar;
(c) wherein said left front cable, said left lateral cable, and said left rear cable attach To said left anchor plate; and
(d) wherein said right front cable, said right lateral cable, and said right rear cable attach to said right anchor plate.

9. The exercise device as recited in claim 1, wherein said control system is configured to create an unloaded path in the motion of said bar.

10. The exercise device as recited in claim 5, wherein said control system is configured to create an unloaded path in the motion of said bar.

11. An exercise device for a user, comprising:
(a) a bar, having an left end and a right end;
(b) a left front motor mounted in a fixed position, driving a left front motor drum;
(c) a left front cable extending from said left front motor drum to said left end of said bar;
(d) a left rear motor mounted in a fixed position, driving a left rear motor drum,
(e) a left rear cable extending from said left rear motor drum to said left end of said bar;
(f) a right front motor mounted in a fixed position, driving a right front motor drum;
(g) a right front cable extending from said right front motor drum to said right end of said bar;

(f) a right rear motor mounted in a fixed position, driving a right rear motor drum;

(h) a right rear cable extending from said right rear motor drum to said right end of said bar;

(i) a control system configured to produce a desired angular position and torque for each of said left front motor, said left rear motor, said right front motor, and said right rear motor in order to apply a desired force to said bar;

(j) a force plate positioned beneath said user;

(k) wherein said force plate is monitored by said control system in order to monitor a balance state of said user; and (l) wherein said control system is configured to remove all loads on all cables in the event an unbalanced state of said user is detected.

12. The exercise device as recited in claim 11, wherein said force plate is suspended on four load cells.

13. The exercise device as recited in claim 12, wherein:

(a) said four load cells are monitored by said control system; and (b) said control system uses said load cells to monitor said balance state of said user.

14. The exercise device as recited in claim 11, further comprising:

(a) a left anchor plate on said left end of said bar;

(b) a right anchor plate on said right end of said bar;

(c) wherein said left front cable and said left rear cable attach to said left anchor plate; and (d) wherein said right front cable and said right rear cable attach to said right anchor plate.

15. The exercise device as recited in claim 11, further comprising:

(a) a left lateral motor driving a left lateral motor drum;

(b) a left lateral cable extending from said left lateral motor drum to said left end of said bar;

(c) a right lateral motor driving a right lateral motor drum; and (d) a right lateral cable extending from said right lateral motor drum to said right end of said bar.

16. The exercise device as recited in claim 15, wherein said force plate is suspended on four load cells.

17. The exercise device as recited in claim 16, wherein:

(a) said four load cells are monitored by said control system; and (b) said control system uses said load cells to monitor said balance state of said user.

18. The exercise device as recited in claim 15, further comprising:

(a) a left anchor plate on said left end of said bar;

(b) a right anchor plate on said right end of said bar;

(c) wherein said left front cable, said left lateral cable, and said left rear cable attach to said left anchor plate; and (d) wherein said right front cable, said right lateral cable, and said right rear cable attach to said right anchor plate.

19. The exercise device as recited in claim 11, wherein said control system is configured to create an unloaded path in the motion of said bar.

20. The exercise device as recited in claim 15, wherein said control system is configured to create an unloaded path in the motion of said bar.

* * * * *